US010533322B2

(12) United States Patent
Zorn et al.

(10) Patent No.: US 10,533,322 B2
(45) Date of Patent: Jan. 14, 2020

(54) ATTACHMENT ASSEMBLY FOR HANGING ARCHITECTURAL MESH AND THE LIKE

(71) Applicant: CAMBRIDGE INTERNATIONAL INC., Cambridge, MD (US)

(72) Inventors: Ivan Gunnar Zorn, Berlin, MD (US); Matthew Charles O'Connell, Cambridge, MD (US)

(73) Assignee: Cambridge International, Inc., Cambridge, MD (US)

( * ) Notice: Subject to any disclaimer, the term of this patent is extended or adjusted under 35 U.S.C. 154(b) by 0 days.

(21) Appl. No.: 15/722,309

(22) Filed: Oct. 2, 2017

(65) Prior Publication Data

US 2018/0094440 A1 Apr. 5, 2018

Related U.S. Application Data

(60) Provisional application No. 62/402,300, filed on Sep. 30, 2016.

(51) Int. Cl.
*E04F 13/08* (2006.01)
*E04F 13/12* (2006.01)
*E04F 13/00* (2006.01)

(52) U.S. Cl.
CPC ..... *E04F 13/0805* (2013.01); *E04F 13/002* (2013.01); *E04F 13/12* (2013.01)

(58) Field of Classification Search
CPC ..... E04F 13/0805; E04F 13/002; E04F 13/12; A47H 23/05; A47H 13/00; A47H 23/04
USPC ..... 52/222, 273, 710, 711; 160/327, 328, 160/330, 332
See application file for complete search history.

(56) References Cited

U.S. PATENT DOCUMENTS 784,312 A * 3/1905 Evans ..... A47H 13/00 160/330
838,867 A * 12/1906 Lalus ..... A47H 13/00 160/330
928,190 A * 7/1909 Flynn ..... A47H 1/142 248/263
2,136,042 A * 11/1938 Cornell ..... E06B 9/0623 160/327
2,958,378 A * 11/1960 Rubens ..... F24B 1/192 160/19
3,231,007 A * 1/1966 Kerr ..... E06B 9/0623 160/332
4,403,642 A * 9/1983 Morris ..... B44C 7/022 160/328
4,449,270 A * 5/1984 Brabant ..... E06B 3/80 16/87.4 R
4,800,947 A * 1/1989 Loomis ..... G09F 15/0025 160/368.1
4,948,313 A * 8/1990 Zankovich ..... E04B 1/4107 411/103
5,110,094 A * 5/1992 Kruse ..... E04H 17/10 256/47

(Continued)

*Primary Examiner* — Brian E Glessner
*Assistant Examiner* — Adam G Barlow
(74) *Attorney, Agent, or Firm* — Quarles & Brady LLP

(57) ABSTRACT

An attachment assembly for architectural mesh includes a hanger member including a hollow tube with an open channel; a wall bracket; and an attachment saddle including a plurality of projecting tabs, the attachment saddle configured to be secured to the wall bracket; wherein the plurality of projecting tabs are configured to slide into the open channel and be retained within the hollow tube.

15 Claims, 9 Drawing Sheets

(56) References Cited

U.S. PATENT DOCUMENTS

| | | | | |
|---|---|---|---|---|
| 5,351,739 | A * | 10/1994 | Levy | A47K 3/38 160/124 |
| 5,732,494 | A * | 3/1998 | Davey | G09F 17/00 160/327 |
| 7,779,888 | B2 | 8/2010 | Messick et al. | |
| 9,049,954 | B2 * | 6/2015 | Messick, Jr. | A47H 13/00 |
| 2004/0099780 | A1 * | 5/2004 | McGee | E03F 5/02 248/289.11 |
| 2006/0075699 | A1 * | 4/2006 | Messick, Jr. | E06B 9/02 52/202 |
| 2006/0090862 | A1 * | 5/2006 | Messick, Jr. | A47H 13/00 160/330 |
| 2014/0283475 | A1 * | 9/2014 | Zhang | F16B 37/0885 52/578 |
| 2015/0265087 | A1 * | 9/2015 | Messick, Jr. | A47H 13/00 160/330 |

* cited by examiner

FIG. 3
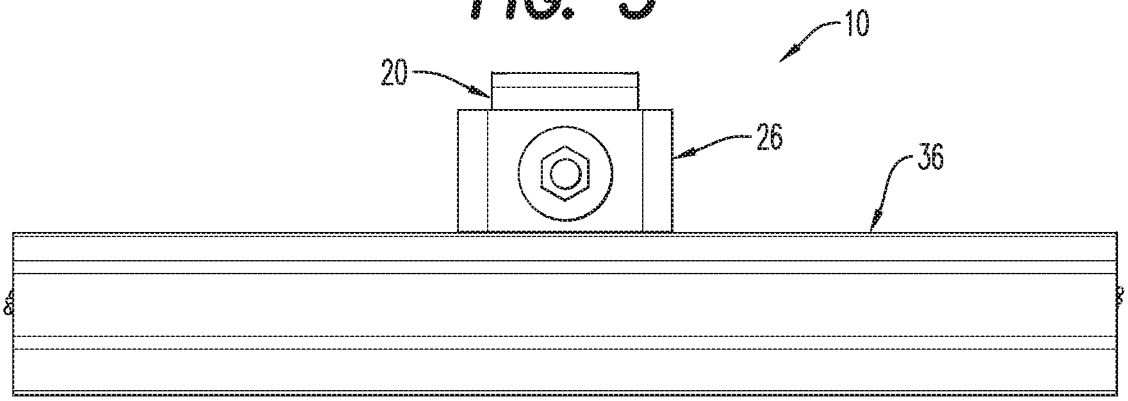
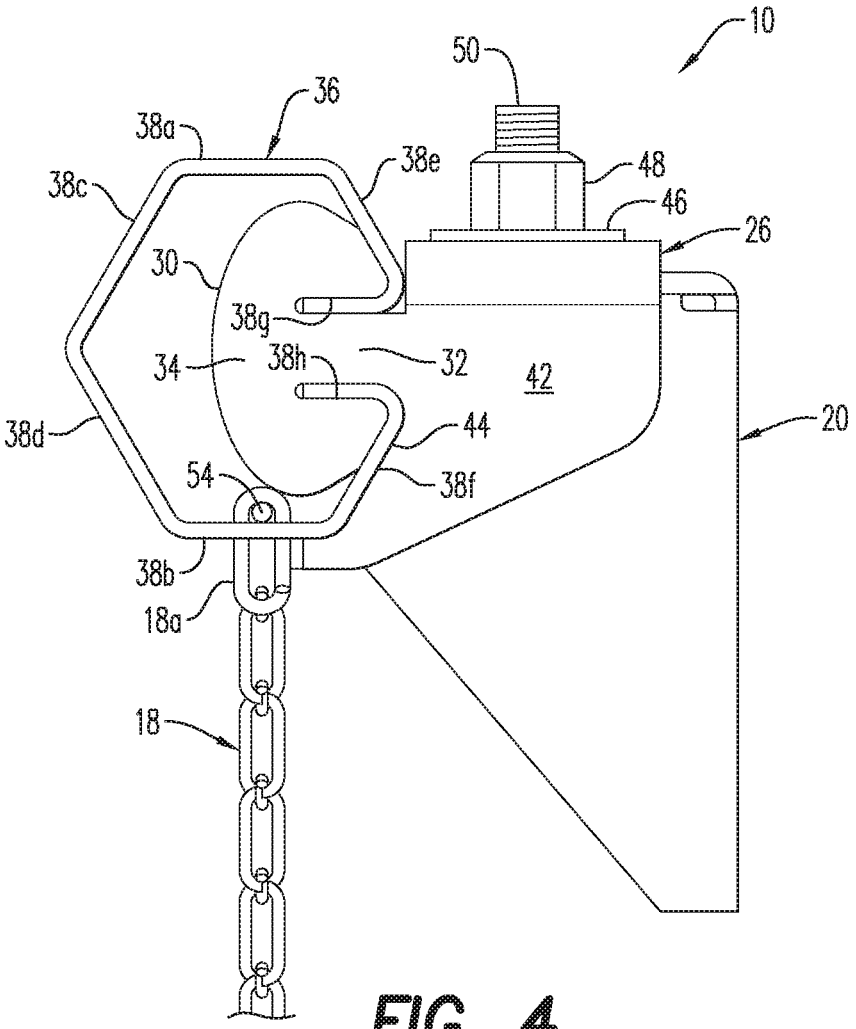
FIG. 4

FIG. 10
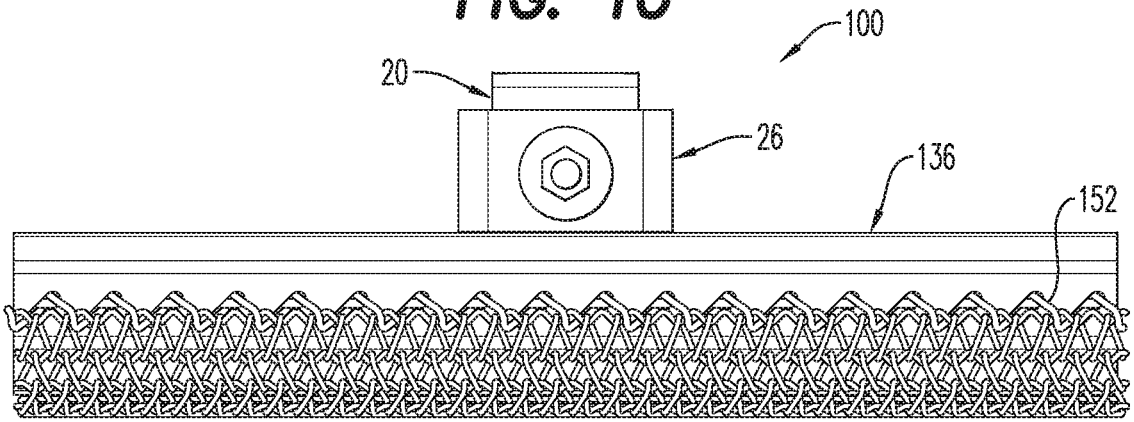
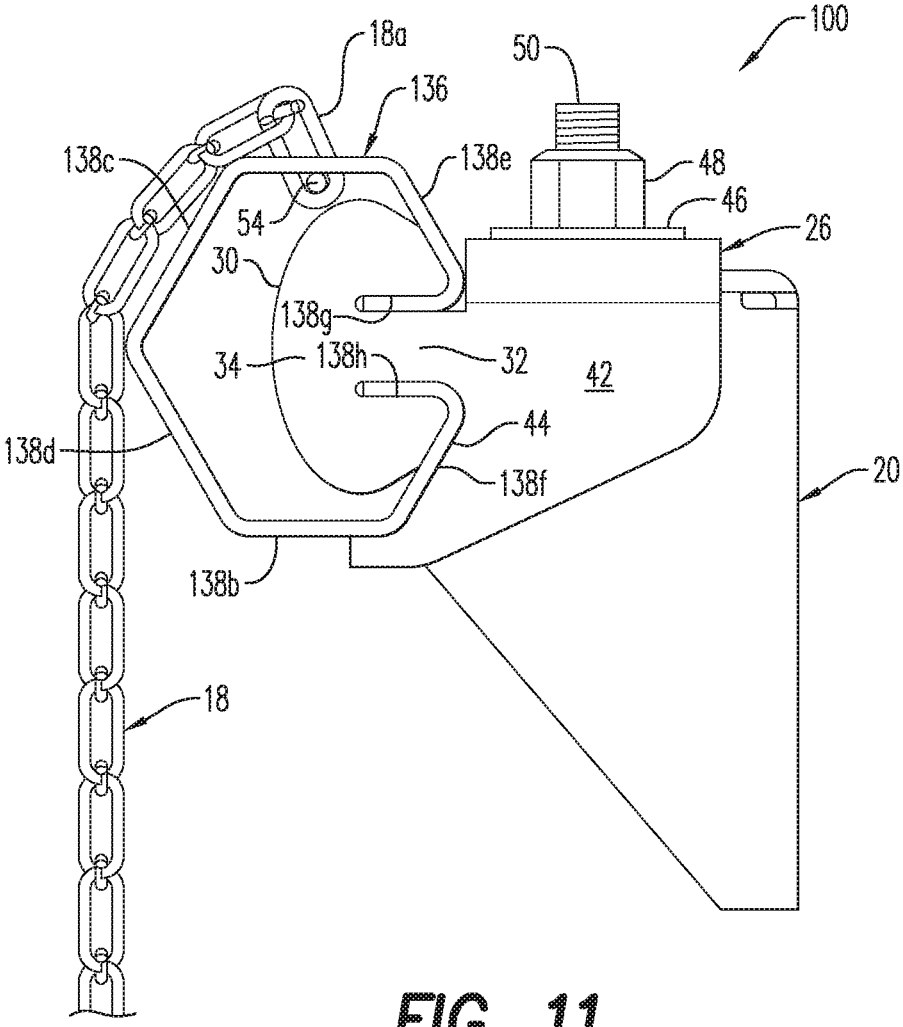
FIG. 11

ATTACHMENT ASSEMBLY FOR HANGING ARCHITECTURAL MESH AND THE LIKE

TECHNICAL FIELD

The present invention is directed to an apparatus for the installation of architectural mesh and, more particularly, to an attachment assembly for the hanging installation of architectural mesh and the like.

BACKGROUND OF THE INVENTION

Architectural metallic meshes are generally used in commercial and business environments to provide elegant wall panels, doors and other surfaces whenever an aesthetic appearance of polish and prestige are of primary importance. Architectural mesh is also an excellent choice for high contact areas, such as the interior walls of elevator cabs, escalator walls, and sales and reception areas, because it is generally scratch, dent and corrosion resistant. As such, architectural metallic mesh maintains a stunning appearance with minimal maintenance.

Woven into panels from brass, stainless steel, copper, and/or other desired metals or alloys, architectural mesh offers a richness of texture, pattern and color that cannot be duplicated by any other material. Architectural mesh can also be polished, finished and combined with different background colors to create a custom look and configuration.

Depending upon the chosen weave, the interstices or apertures between the weft or fill wires and the warp wires may allow light to pass through the architectural mesh. Alternatively, if the weave is tight and the wires are more closely adjacent to one another, the passage of light through the mesh will be selectively prevented and the mesh can provide for privacy. Accordingly, as the requirement for incorporating energy savings into building design increases, and hence the need for architecturally acceptable sun shading or screening, architectural mesh offers a variety of options that can meet the shading needs while still maintaining architectural requirements and aesthetic appeal.

Prior architectural mesh hanging systems for a building or similar structure are shown for example in U.S. Pat. Nos. 7,779,888 and 9,049,954 to the present assignee, the entire contents of both of which are hereby incorporated by reference. U.S. Pat. No. 7,779,888 discloses a hanging system including an architectural mesh panel, a first support member, and a second support member. At least two upper hanger assemblies support the first support member and are attachable to a support surface for hanging the architectural mesh panel. At least two lower hanger assemblies support the second support member and are attachable to the support surface for hanging the architectural mesh panel. The architectural mesh panel is disposed at least partially about the first support member and the second support member such that, when hanging, the first and second support members are substantially obscured from view by the architectural mesh panel. U.S. Pat. No. 9,049,954 discloses an architectural mesh hanging system having a hanger assembly including a hanger tube having a plurality of openings and an architectural mesh panel having an uppermost edge defined by a plurality of loops. The plurality of loops are positioned within the plurality of openings in the hanger tube and a retaining rod is disposed through the plurality of loops within an interior of the hanger tube, thereby preventing the plurality of loops from displacement out of the plurality of opening.

While both of the above-mentioned architectural mesh hanging systems have met with commercial success, the welded assembly required therein poses certain restrictions for field installation. Thus, it would be desirable to provide an attachment assembly for reliably and conveniently applying an architectural mesh product to a building wall or similar structure without significant welding, so as to simplify field installations and to create the desired sun shading or privacy without detracting from the aesthetic appearance of the wall.

SUMMARY

The disclosure here is directed to an attachment assembly for architectural mesh comprising a hanger member including a hollow tube with an open channel; a wall bracket; and an attachment saddle including a plurality of projecting tabs, the attachment saddle configured to be secured to the wall bracket; wherein the plurality of projecting tabs are configured to slide into the open channel and be retained within the hollow tube.

A further aspect of the disclosure is directed to an architectural mesh hanging system comprising an attachment assembly including a hanger member defining a hollow tube having a plurality of openings and an open channel; an architectural mesh panel of predetermined size, said mesh panel having an uppermost edge defined by a plurality of loops, wherein said plurality of loops are positioned within said plurality of openings in said hanger member; a wall bracket; and an attachment saddle including a plurality of projecting tabs, the attachment saddle configured to be secured to the wall bracket; wherein the plurality of projecting tabs are configured to slide into the open channel and be retained within the hollow tube of the hanger member.

Another aspect of the disclosure is directed to a method of hanging an architectural mesh panel, said method comprising securing a support structure to a support surface, the support structure including a plurality of projecting tabs; inserting an uppermost edge of the architectural mesh panel through openings in a substantially hollow hanger member, the uppermost edge comprising a plurality of loops and the hanger member defining an open channel; inserting a splice rod through the plurality of loops of the uppermost edge of the architectural mesh panel; aligning the open channel of the hanger member with the projecting tabs of the support structure; and sliding the hanger member along the projecting tabs to thereby secure the hanger member to the support structure.

BRIEF DESCRIPTION OF THE DRAWINGS

These and other features, and advantages of the disclosure will become more readily apparent to those skilled in the art upon reading the following detailed description, in conjunction with the appended drawings in which:

FIG. 3 is a top view of the attachment assembly.

FIG. 4 side schematic view of the attachment assembly.

FIG. 10 is a top view of the attachment assembly.

FIG. 11 side schematic view of the attachment assembly.

DETAILED DESCRIPTION

Figure 1:
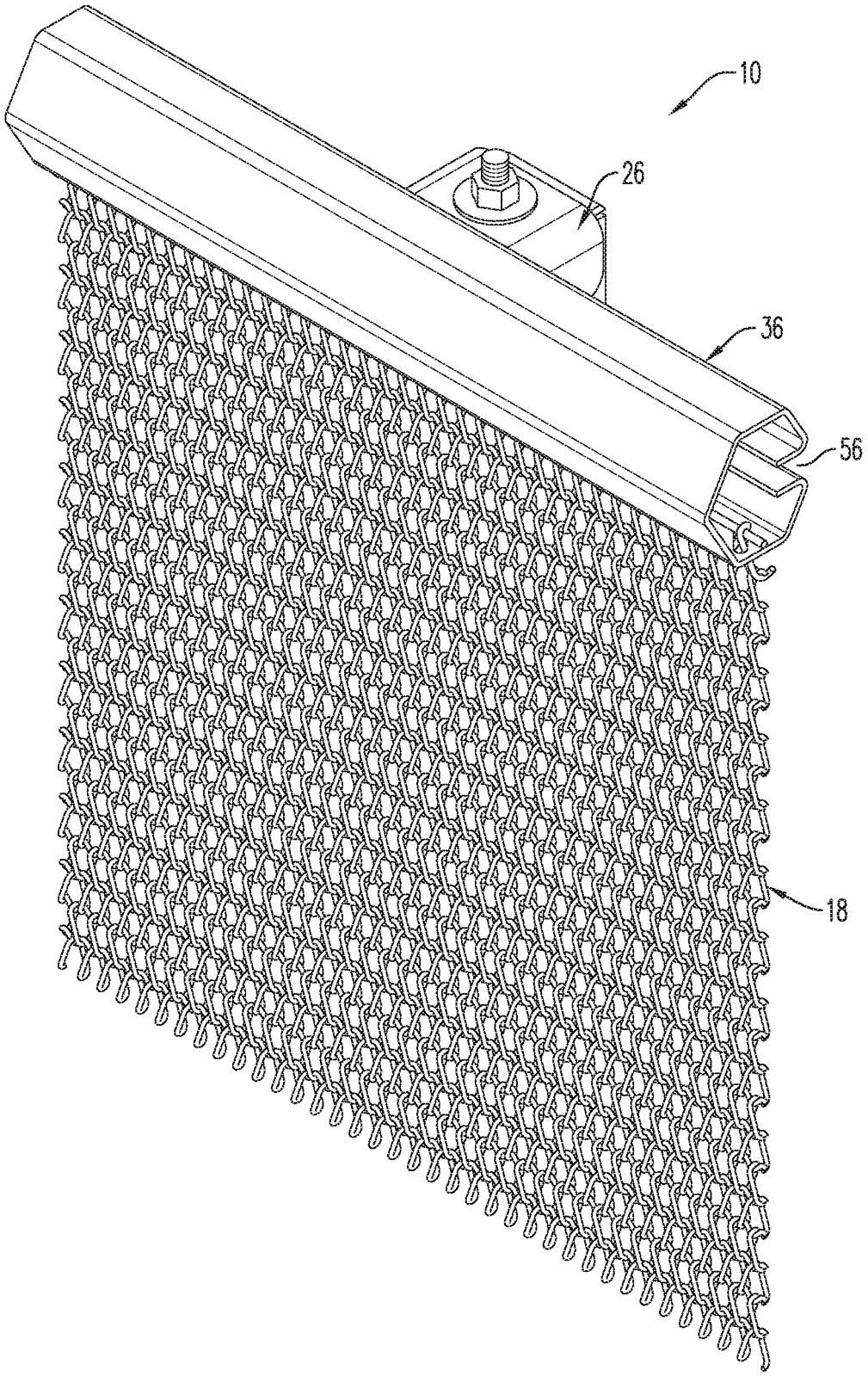
FIG. 1 is a perspective view of an attachment assembly according to a first exemplary embodiment of the disclosure herein.
Figure 2:
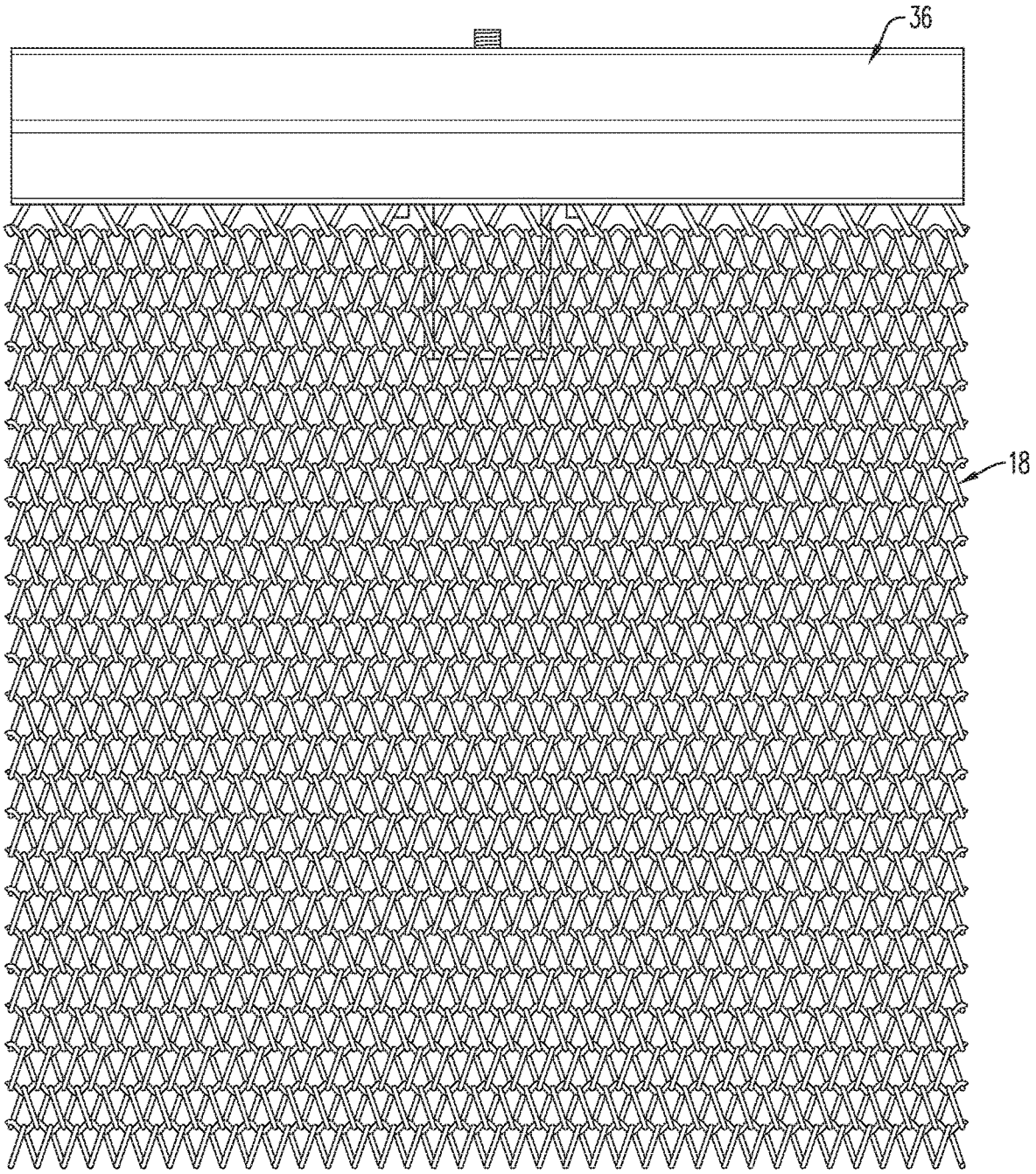
FIG. 2 is a front elevational view of the attachment assembly.

The attachment assembly according to a first exemplary embodiment of the disclosure is designated generally by reference numeral 10, as shown in FIG. 1.

Referring also to FIGS. 2-7, the attachment assembly 10 is preferably disposed at an upper vertical edge of a section of architectural mesh 18 or a similar metal configuration. The attachment assembly 10 includes a wall bracket 20 preferably attached to a vertical support surface (not shown) disposed parallel to the desired hanging plane of the architectural mesh 18. An attachment saddle 26 is disposed on top of the wall bracket 20 and a fastener extends therethrough to secure the attachment saddle 26 to the wall bracket 20. A preformed hanger member 36, preferably a hollow tube having a predetermined length suitable for the width of the architectural mesh panel 18, is secured to the attachment saddle 26.

Figure 5:
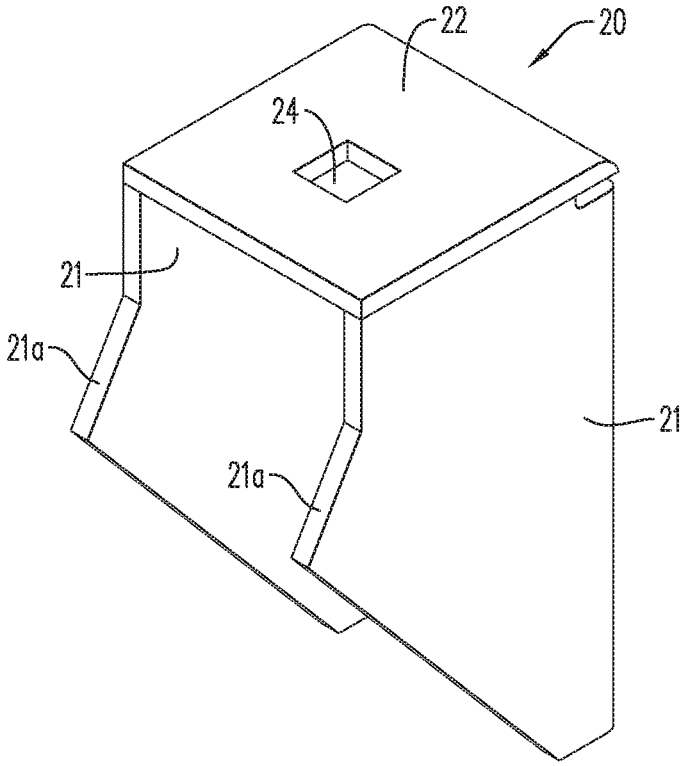
FIG. 5 is perspective view of the wall bracket in the attachment assembly.

As shown in FIG. 5, the wall bracket 20 includes opposing side surfaces 21 and a top surface 22 having a through-opening 24. The attachment saddle 26 also includes opposing side surfaces 42 and a through-opening 28 on a top surface 27. The through-opening 28 on the saddle is preferably formed as a slot to allow for forward/backward adjustment or tolerance relative to the vertical support surface and in particular, when more than one bracket is being used on a single tube such as hanger member 36. The attachment saddle 26 is configured to sit on top of the wall bracket 20 such that the inner surfaces of the attachment saddle sides 42 are in facing relationship with the outer surfaces of the wall bracket sides 21. When the attachment saddle 26 is disposed over the wall bracket 20, the through-openings 24, 28 are aligned and a fastener is inserted to secure the attachment saddle and wall bracket together. As shown, a washer 46 and nut 48 are preferably disposed on a bolt 50 inserted from a bottom of the wall bracket 20 or otherwise secured thereto. Other types of fastening means can of course also be used as would be apparent to one skilled in the art.

The attachment saddle 26 includes a projecting tab 30 extending from each side 42, each tab having a neck portion 32 and a head portion 34, the purpose of which will be described below. Each side 42 also includes an angled extension 44 as shown best in FIG. 4.

Figure 6:
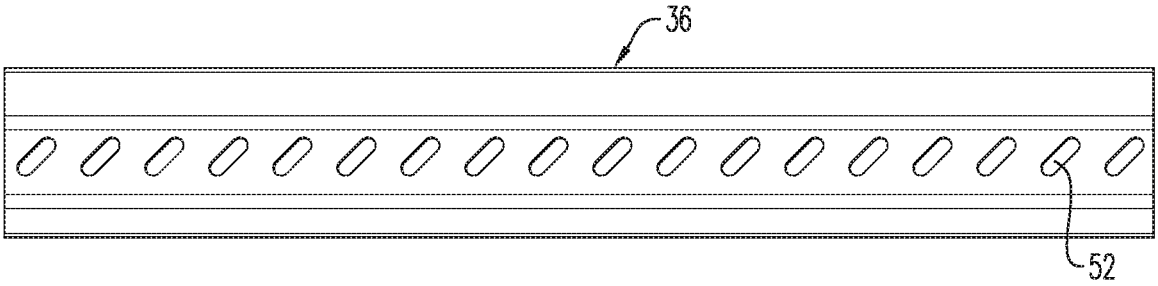
FIG. 6 is a bottom view of the hanger member in the attachment assembly.
Figure 7:
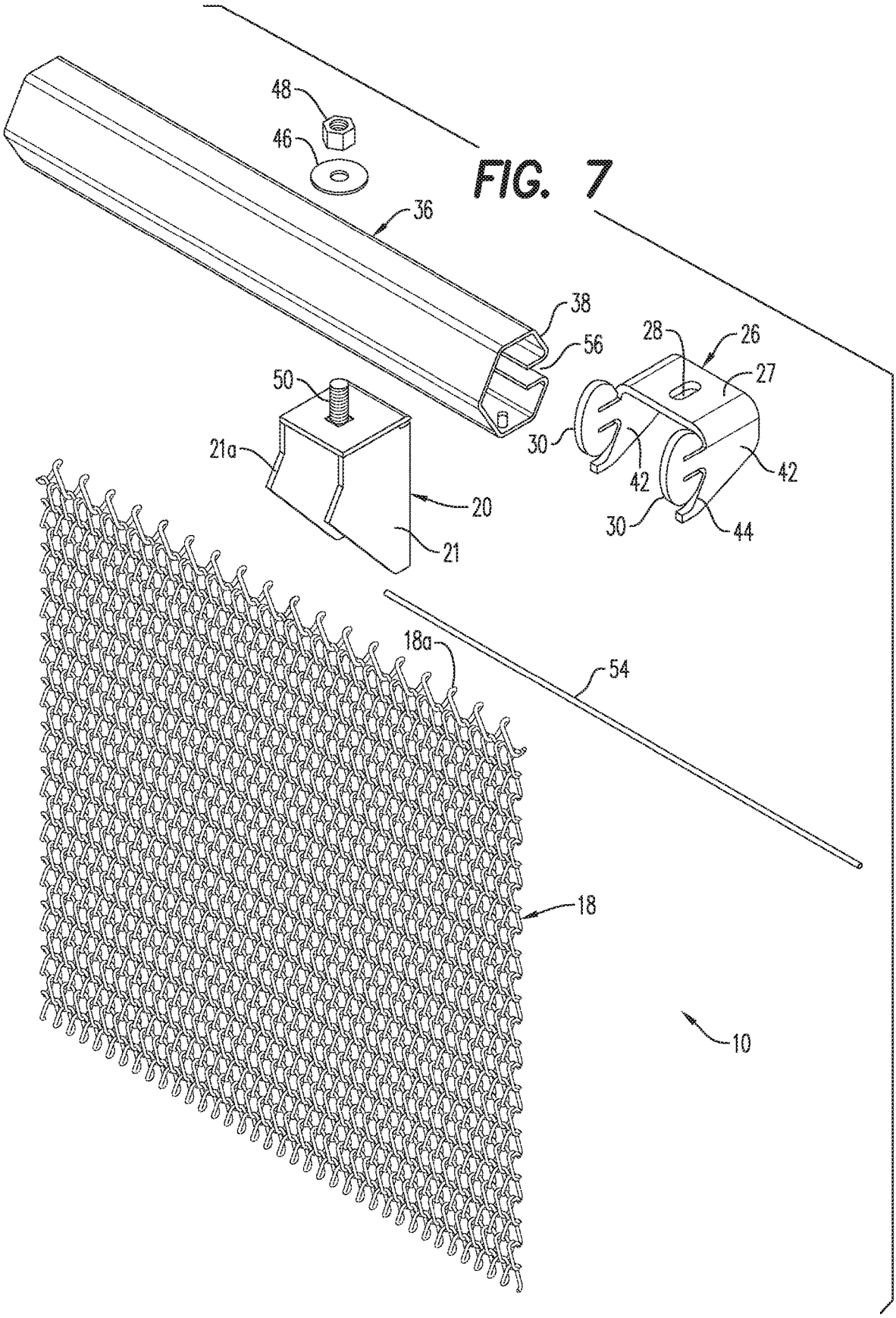
FIG. 7 is an exploded view of the attachment assembly shown in FIG. 1.

In the first exemplary embodiment, the hanger member 36 includes a plurality of slots 52 on the bottom surface thereof, as shown best in FIG. 6. The mesh 18, and more particularly each of the uppermost loops or connection spiral 18*a* of the mesh 18, extends through a respective one of the slots 52 and into the interior of the hanger member 36. Depending upon the particular mesh, the connection spiral 18*a* may be different from the spiral loops of the mesh 18 in order to fit with the slots 52. Alternatively, if the connection spiral 18*a* is not used, the slots 52 within the hanger member 36 may be custom cut to exactly fit the uppermost loop of the mesh and thus eliminate the need for a specially formed connection spiral 18*a*. Within the hanger member, each of the uppermost loops 18*a* receives a retainer or attachment splice rod 40 extending the length of the hanger member 36. Thus, the rod 54 extends through the hanger member 36 and engages the loops 18*a* of the mesh 18 forming the architectural panel. A retainer pin may also be disposed on each terminal end of the hanger member 36 to further secure the rod 54 against horizontal movement. Moreover, because the uppermost loop of the mesh material and the rod 54 are within the hanger member 36, these supporting elements are substantially hidden from view when the architectural panel 18 is installed in the desired application; thus not detracting from the aesthetic appeal of the architectural panel 18.

The hanger member 36 includes a preformed hexagonal body 38 in the first exemplary embodiment, the hexagonal body 38 having top and bottom surfaces 38*a*, 38*b*, front surfaces 38*c*, 38*d*, and rear surfaces 38*e*, 38*f* As shown best in FIG. 4, rear surfaces 38*e*, 38*f* connect to surfaces 38*g*, 38*h* which extend inward towards the hollow interior of hanger member 36 and form a groove or open channel 56 on the rear of the hanger member 36. The open channel 56 allows the attachment saddle 26 with projecting tabs 30 to be slid into the hanger member 36 from either end. More particularly, the open channel 56 is dimensioned to allow the neck portion 32 of the projecting tabs 30 to pass therebetween and the head portion 34 of the projecting tabs 30 are retained within the hollow interior of the hanger member 36. In the assembled state, the lower rear surface 38*f* of the hexagonal body 38 will abut the attachment saddle 26 and the angled front portion 21*a* of the sides 21 of the wall bracket 20. The wall bracket 20 and attachment saddle 26 are thus configured in accordance with the angle of the hexagonal body 38. Shapes other than the hexagonal body could be used for the tubular hanger member 36, but in so doing one skilled in the art will recognize that the wall bracket and attachment saddle will then also be formed with a cooperating shape to maintain the strength and structural integrity of the assembly.

With the above-described construction of the attachment assembly 10, the attachment saddle 26 does not have to be welded as it did in the above-discussed prior attachment systems, and it can therefore be adjusted to accommodate wall bracket 20 spacing requirements in a field environment. This adjustability allows unforeseen construction conditions and dimensions to be accommodated without the need to remanufacture components in order to change wall bracket spacing.

Figure 8:
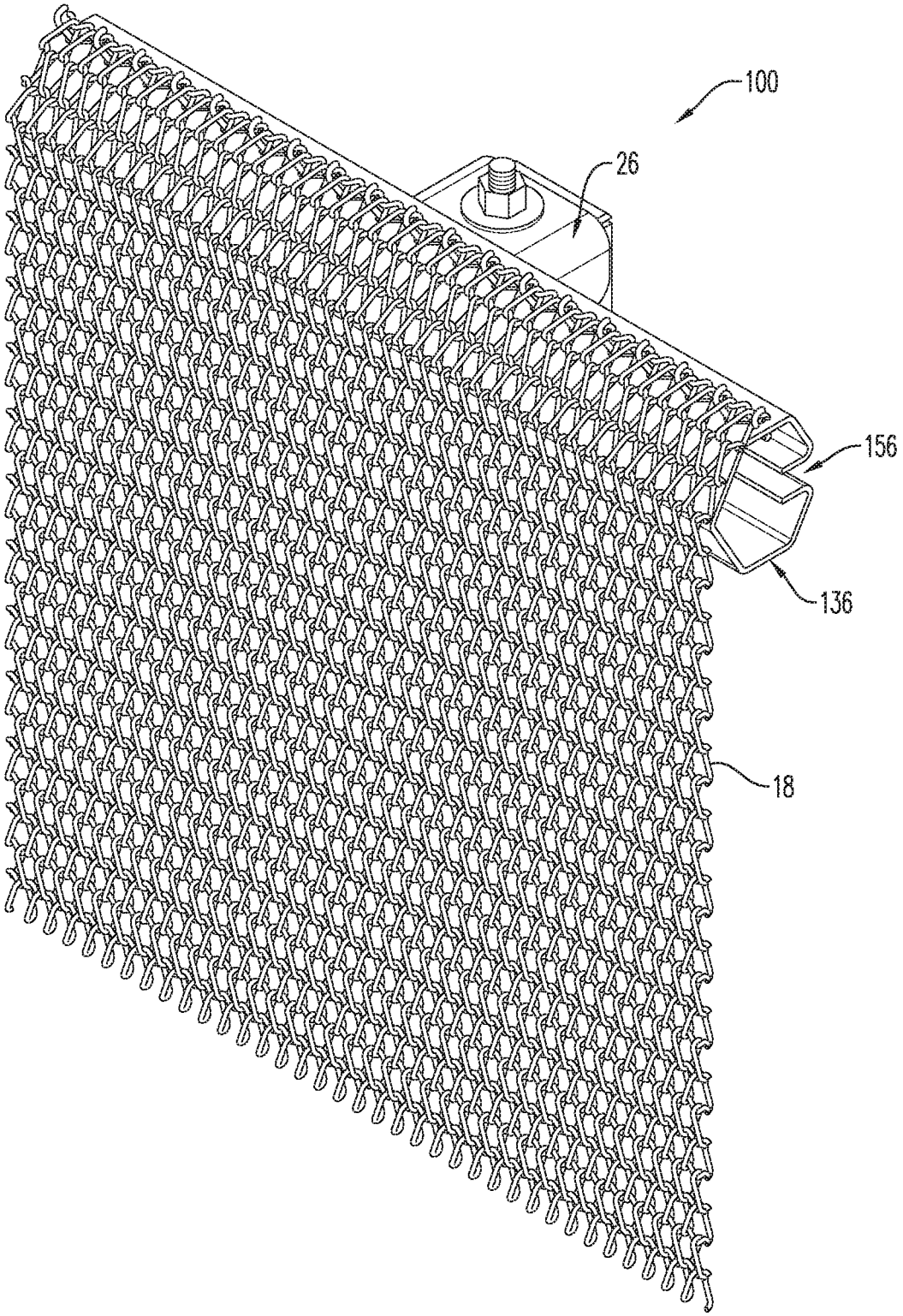
FIG. 8 is a perspective view of an attachment assembly according to a second exemplary embodiment of the disclosure herein.
Figure 9:
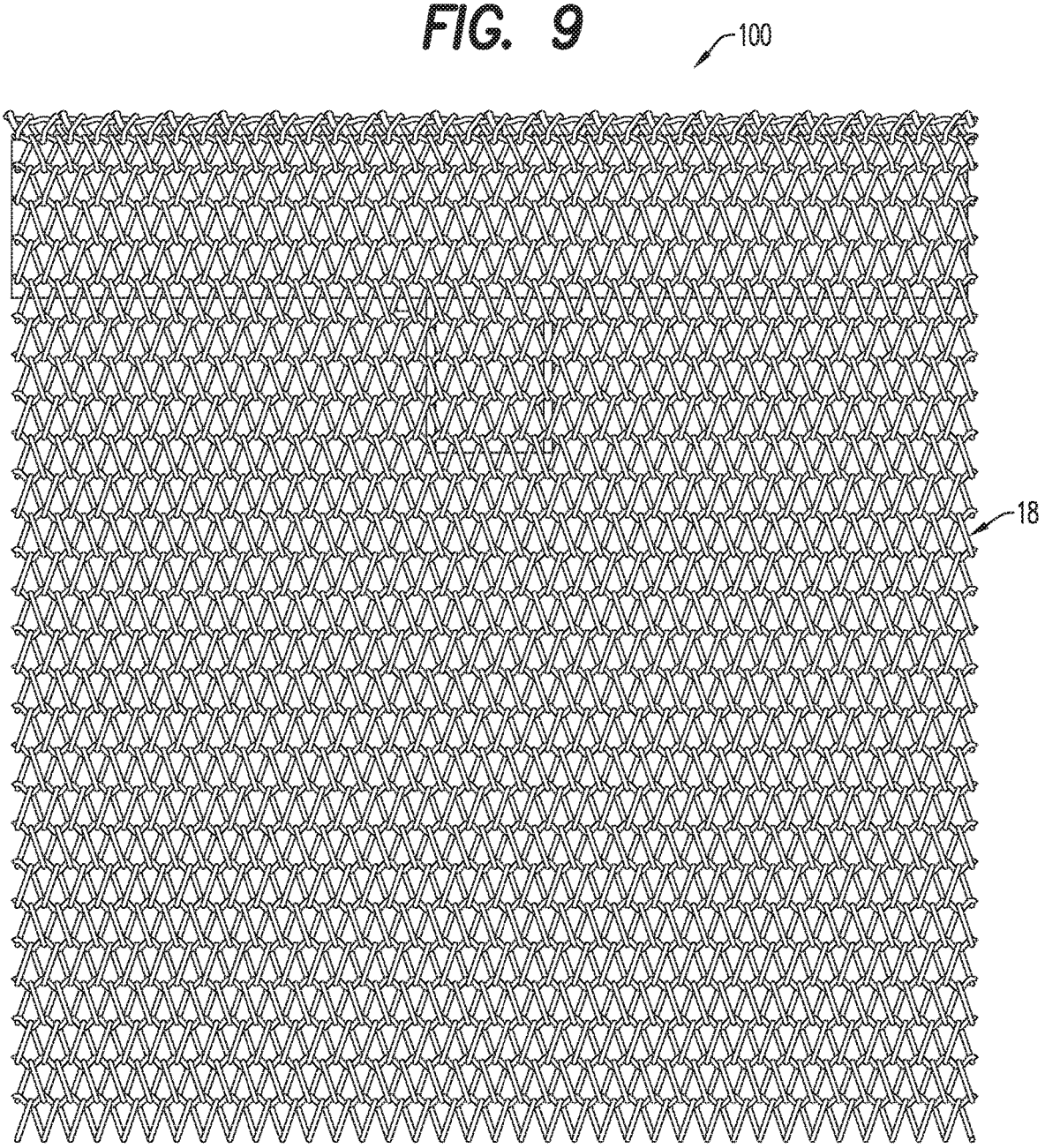
FIG. 9 is a front elevational view of the attachment assembly.

The attachment assembly according to a second exemplary embodiment of the disclosure is designated generally by reference numeral 100, as shown in FIG. 8, with like reference numerals being used to represent like parts.

Referring also to FIGS. 9-12, the attachment assembly 100 is preferably disposed at an upper vertical edge of a section of architectural mesh 18 or a similar metal configuration. The attachment assembly 10 includes a wall bracket 20 preferably attached to a vertical support surface (not shown) disposed parallel to the desired hanging plane of the architectural mesh 18. An attachment saddle 26 is disposed on top of the wall brackets 20 and a fastener extends therethrough to secure the attachment saddle 26 to the wall bracket 20. A preformed hanger member 136, preferably a hollow tube having a predetermined length suitable for the width of the architectural mesh panel 18, is secured to the attachment saddle 26.

The wall bracket 20 as discussed above includes opposing side surfaces 21 and a top surface 22 having a through-opening 24. The attachment saddle 26 also includes opposing side surfaces 42 and a through-opening 28 on a top surface 27. The attachment saddle 26 is configured to sit on top of the wall bracket 20 such that the inner surfaces of the attachment saddle sides 42 are in facing relationship with the outer surfaces of the wall bracket sides 21. When the attachment saddle 26 is disposed over the wall bracket 20, the through-openings 24, 28 are aligned and a fastener is inserted to secure the attachment saddle and wall bracket together. As shown, a washer 46 and nut 48 are preferably disposed on a bolt 50 inserted from a bottom of the wall bracket 20. Other types of fastening means can of course also be used as would be apparent to one skilled in the art.

The attachment saddle 26 includes a projecting tab 30 extending from each side 42, each tab having a neck portion 32 and a head portion 34, the purpose of which will be described below. Each side 42 also includes an angled extension 44 as shown best in FIG. 4.

Figure 12:
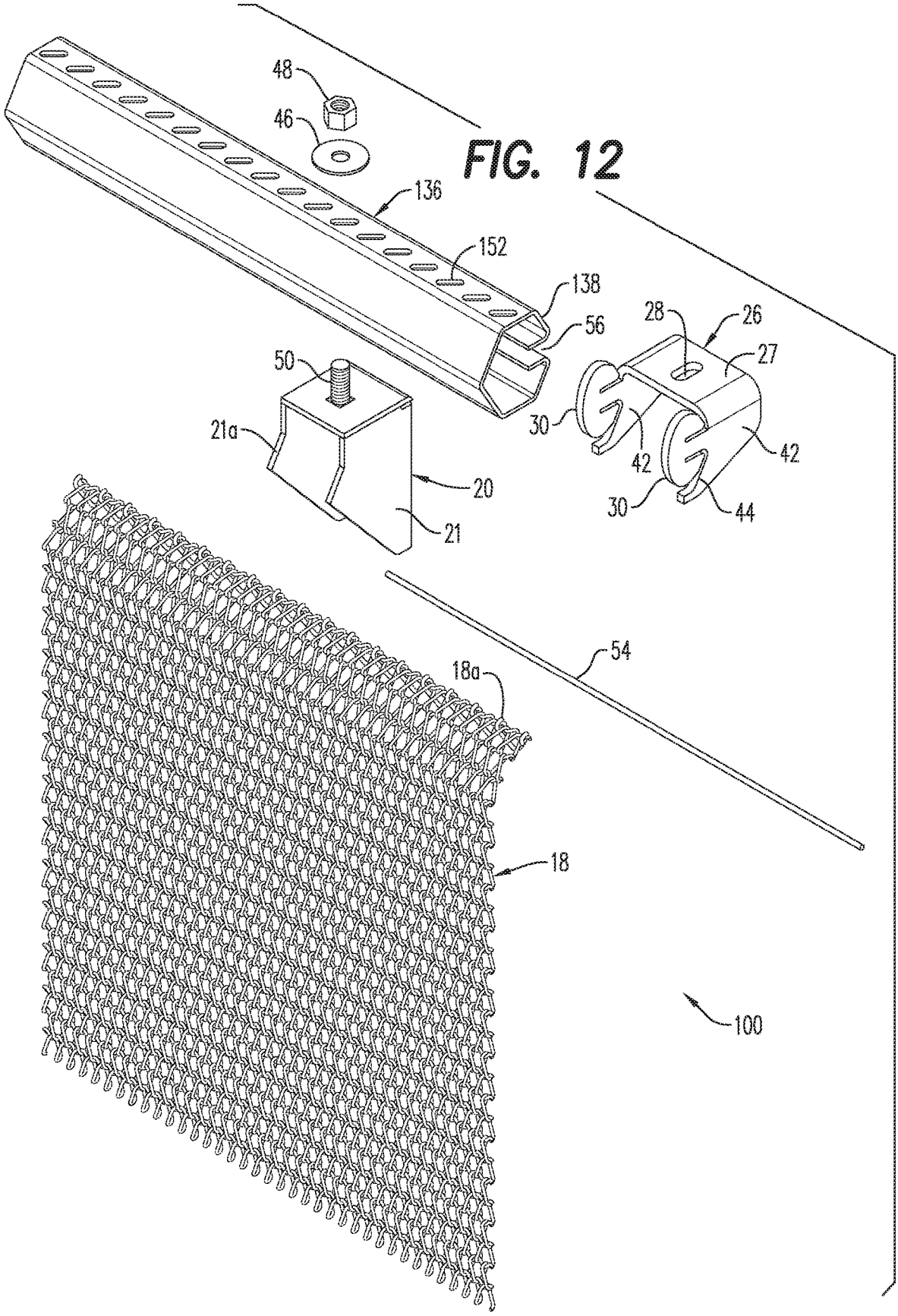
FIG. 12 is an exploded view of the attachment assembly shown in FIG. 8.

In the second exemplary embodiment, the hanger member 136 includes a plurality of slots 152 on the top surface thereof, as shown best in FIG. 12. The mesh 18, and more particularly each of the uppermost spiral loops 18*a* of the mesh 18, extends through a respective one of the slots 152 and downward into the interior of the hanger member 136. Depending upon the particular mesh, the connection spiral 18*a* may be different from the spiral loops of the mesh 18 in order to fit with the slots 152. Alternatively, if the connection spiral 18*a* is not used, the slots 152 within the hanger member 136 may be custom cut to exactly fit the uppermost loop of the mesh and thus eliminate the need for a specially formed connection spiral 18*a*. Within the hanger member, each of the uppermost loops 18*a* receives a retainer or attachment splice rod 54 extending the length of the hanger member 136. Thus, the rod 54 extends through the hanger member 136 and engages the loops 18*a* of the mesh 18 forming the architectural panel. A retainer pin may also be disposed on each terminal end of the hanger member 136 to further secure the rod 54 against horizontal movement. Moreover, because the uppermost loop of the mesh material and the rod 54 are within the hanger member 136 and the mesh wraps around the front surface 138*c* of the hanger member 136, the hanger member 136 and the supporting elements are substantially hidden from view when the architectural panel 18 is installed in the desired application; thus not detracting from the aesthetic appeal of the architectural panel 18.

The hanger member 136 includes a preformed hexagonal body 138 in the second exemplary embodiment, the hexagonal body 138 having top and bottom surfaces 138*a*, 138*b*, front surfaces 138*c*, 138*d*, and rear surfaces 138*e*, 138*f*. As shown best in FIG. 11, rear surfaces 138*e*, 138*f* connect to surfaces 138*g*, 138*h* which extend inward towards the hollow interior of hanger member 136 and form a groove or open channel 156 on the rear of the hanger member 136. The open channel 156 allows the attachment saddle 26 with projecting tabs 30 to be slid into the hanger member 136 from either end. More particularly, the open channel 156 is dimensioned to allow the neck portion 32 of the projecting tabs 30 to pass therebetween and the head portion 34 of the projecting tabs 30 are retained within the hollow interior of the hanger member 136. As in the first exemplary embodiment, in the assembled state, the lower rear surface 138*f* of the hexagonal body 138 will abut the attachment saddle 26 and the angled front portion 21*a* of the sides 21 of the wall bracket 20. The wall bracket 20 and attachment saddle 26 are thus configured in accordance with the angle of the hexagonal body 138. Shapes other than the hexagonal body could be used for the tubular hanger member 136, but in so doing one skilled in the art will recognize that the wall bracket and attachment saddle will then also be formed with a cooperating shape to maintain the strength and structural integrity of the assembly.

With such construction, the attachment saddle 26 does not have to be welded as it did in the above-discussed prior attachment systems, and it can therefore be adjusted to accommodate wall bracket 20 spacing requirements in a field environment. This adjustability allows unforeseen construction conditions and dimensions to be accommodated without the need to remanufacture components in order to change wall bracket spacing.

The exemplary embodiments above disclose an attachment saddle 26 including a projecting tab 30 extending from each side 42 thereof and an angled extension 44 along a front edge. The angled extension 44 is preferred but not considered necessary to the invention disclosed herein as it requires precise forming in order to achieve the desired assembly of the attachment assembly. Other configurations of the attachment saddle 26 are also envisioned that could include either fewer or a greater number of projecting tabs within the scope of the disclosure, including a single tab extending across the front of the saddle.

While the present invention has been described with respect to a particular embodiment of the present invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the present invention.

The invention claimed is:

1. An attachment assembly for architectural mesh comprising:

a hanger member including a hollow tube defining a longitudinal axis and an open channel having a predetermined width;

a wall bracket; and an attachment saddle including a plurality of projecting tabs, the attachment saddle configured to be secured to the wall bracket;

wherein each of the plurality of projecting tabs includes a neck portion having a first width smaller than the predetermined width of the open channel and a head portion having a second width greater than the predetermined width of the open channel; and wherein the open channel is dimensioned to allow only the neck portion of the plurality of projecting tabs to pass through the open channel, whereby the projecting tabs are retained within the hollow tube by the head portion of the plurality of projecting tabs;

wherein the wall bracket includes opposing side surfaces and a top surface having a through-opening; and wherein the attachment saddle includes opposing side surfaces and a top surface having a through-opening, the attachment saddle configured to be disposed over the wall bracket such that the through-opening of the wall bracket is aligned with the through-opening of the attachment saddle.

2. The attachment assembly according to claim 1, wherein the hanger member includes a preformed body having inwardly extending rear surfaces which define the open channel.

3. The attachment assembly according to claim 2, wherein the open channel forms a groove.

4. The attachment assembly according to claim 2, wherein the open channel is dimensioned to allow the neck portions of the projecting tabs to pass therebetween and the head portions of the projecting tabs to be retained within an interior of the hollow tube.

5. The attachment assembly according to claim 2, wherein the preformed body is hexagonal in shape.

6. An architectural mesh hanging system comprising:

an attachment assembly including a hanger member defining a hollow tube having a plurality of openings and an open channel;

an architectural mesh panel of predetermined size, said mesh panel having an uppermost edge defined by a plurality of loops, wherein said plurality of loops are positioned within said plurality of openings in said hanger member;

a wall bracket, the wall bracket including opposing side members and a top member having a through-opening; and an attachment saddle including opposing side members and a top member having a through-opening, each side member including a projecting tab, the attachment saddle configured to be disposed over the wall bracket such that the through-opening of the wall bracket is aligned with the through-opening of the attachment saddle and an inner surface of each opposing side member of the attachment saddle is in facing relationship with an outer surface of a respective opposing side member of the wall bracket;

wherein the projecting tabs are configured to slide into the open channel and be retained within the hollow tube of the hanger member.

7. The hanging system according to claim 6, wherein the plurality of openings are disposed on a lower surface of the hollow tube.

8. The hanging system according to claim 6, wherein the plurality of opening are disposed on an upper surface of the hollow tube.

9. The hanging system according to claim 6, wherein each of the projecting tabs includes a neck portion and a head portion.

10. The hanging system according to claim 9, wherein the hanger member includes a preformed body having inwardly extending rear surfaces which define the open channel.

11. The hanging system according to claim 10, wherein the open channel forms a groove.

12. The hanging system according to claim 10, wherein the open channel is dimensioned to allow the neck portions of the projecting tabs to pass therebetween and the head portions of the projecting tabs to be retained within an interior of the hollow tube.

13. The hanging system according to claim 10, wherein the preformed body is hexagonal in shape.

14. The attachment assembly according to claim 1, wherein each of the plurality of projecting tabs is disposed perpendicular to the longitudinal axis of the hollow tube.

15. The hanging system according to claim 6, wherein the plurality of projecting tabs are disposed perpendicular to a longitudinal axis of the hollow tube.

* * * * *